US008778096B2

(12) United States Patent
Shimamura et al.

(10) Patent No.: US 8,778,096 B2
(45) Date of Patent: Jul. 15, 2014

(54) LOW YIELD RATIO, HIGH STRENGTH AND HIGH TOUGHNESS STEEL PLATE AND METHOD FOR MANUFACTURING THE SAME

(75) Inventors: Junji Shimamura, Fukuyama (JP); Nobuyuki Ishikawa, Fukuyama (JP); Nobuo Shikanai, Chiyoda-ku (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 13/499,472

(22) PCT Filed: Sep. 28, 2010

(86) PCT No.: PCT/JP2010/067316

§ 371 (c)(1),
(2), (4) Date: Jun. 8, 2012

(87) PCT Pub. No.: WO2011/040624

PCT Pub. Date: Apr. 7, 2011

(65) Prior Publication Data

US 2012/0241057 A1 Sep. 27, 2012

(30) Foreign Application Priority Data

Sep. 30, 2009 (JP) ..... 2009-226704

(51) Int. Cl.
*C22C 38/04* (2006.01)
*C22C 38/60* (2006.01)

(52) U.S. Cl.
USPC ..... 148/328; 148/330; 148/332; 148/333; 148/334; 148/335; 148/336; 148/337; 148/654; 420/84; 420/89; 420/90; 420/91; 420/92; 420/93

(58) Field of Classification Search
USPC ..... 420/84, 89–93, 104–112, 119, 420/121–124, 126; 148/328, 330, 332–337, 148/654
See application file for complete search history.

(56) References Cited

FOREIGN PATENT DOCUMENTS

| | | | |
|---|---|---|---|
| EP | 1662014 A1 | | 5/2006 |
| EP | 1870484 A1 | | 12/2007 |
| JP | 55-041927 A | | 3/1980 |
| JP | 55-097425 A | | 7/1980 |
| JP | S57110650 A | * | 7/1982 |

(Continued)

OTHER PUBLICATIONS

International Search Report dated Dec. 21, 2010, application No. PCT/JP2010/067316.

(Continued)

*Primary Examiner* — Sikyin Ip
(74) *Attorney, Agent, or Firm* — RatnerPrestia

(57) ABSTRACT

Provided is a low yield ratio, high strength and high toughness steel plate having excellent strain ageing resistance equivalent to API 5L X70 Grade or lower and a method for manufacturing the same. The steel plate has a metallographic microstructure that is a three-phase microstructure including bainite, M-A constituent, and quasi-polygonal ferrite, the area fraction of the bainite being 5% to 70%, the area fraction of the M-A constituent being 3% to 20%, the remainder being the quasi-polygonal ferrite, the equivalent circle diameter of the M-A constituent being 3.0 μm or less. The steel plate has a yield ratio of 85% or less and a Charpy impact test absorbed energy of 200 J or more at −30° C. before or after being subjected to strain ageing treatment at a temperature of 250° C. or lower for 30 minutes or less.

4 Claims, 2 Drawing Sheets

(56) References Cited

FOREIGN PATENT DOCUMENTS

| | | | | |
|---|---|---|---|---|
| JP | 11-76027 | A | | 7/1989 |
| JP | 3-264646 | A | | 11/1991 |
| JP | 03264645 | A | * | 11/1991 |
| JP | 9-049026 | A | | 2/1997 |
| JP | 11-256270 | A | | 9/1999 |
| JP | 2000-239791 | A | | 9/2000 |
| JP | 2004-300567 | A | | 10/2004 |
| JP | 2004315925 | A | * | 11/2004 |
| JP | 2005-048224 | A | | 2/2005 |
| JP | 2005-060835 | A | | 3/2005 |
| JP | 2005-060839 | A | | 3/2005 |
| JP | 2005-060840 | A | | 3/2005 |
| JP | 2006-265577 | A | | 10/2006 |
| JP | 2007-31796 | A | | 2/2007 |
| JP | 2008-101242 | A | | 5/2008 |
| JP | 2008-248328 | A | | 10/2008 |
| JP | 2009-120876 | A | | 6/2009 |

OTHER PUBLICATIONS

Supplementary European Search Report dated Jan. 29, 2013, application No. EP10820736.

* cited by examiner

LOW YIELD RATIO, HIGH STRENGTH AND HIGH TOUGHNESS STEEL PLATE AND METHOD FOR MANUFACTURING THE SAME

CROSS-REFERENCE TO RELATED APPLICATIONS

This application is the U.S. National Phase application of PCT International Application No. PCT/JP2010/067316, filed Sep. 28, 2010, and claims priority to Japanese Patent Application No. 2009-226704, filed Sep. 30, 2009, the disclosures of which PCT and priority applications are incorporated herein by reference in their entireties for all purposes.

FIELD OF THE INVENTION

The present invention relates to low yield ratio, high strength and high toughness steel plates suitable for use mainly in the field of line pipes and methods for manufacturing the same and particularly relates to a low yield ratio, high strength and high toughness steel plate having excellent strain ageing resistance and a method for manufacturing the same.

BACKGROUND OF THE INVENTION

In recent years, steels for welded structures have been required to have low yield strength and high uniform elongation in addition to high strength and high toughness from an earthquake-proof point of view. In general, it is known that steel is enabled to have low yield strength and high uniform elongation in such a manner that the metallographic microstructure of the steel is transformed into a microstructure in which a hard phase such as bainite or martensite is adequately dispersed in ferrite, which is a soft phase. The term "uniform elongation" as used herein is also called even elongation and refers to the limit of the permanent elongation of a parallel portion of a specimen uniformly deformed in a tensile test. The uniform elongation is usually determined in the form of the permanent elongation corresponding to the maximum tensile load.

As for manufacturing methods capable of obtaining a microstructure in which a hard phase is adequately dispersed in a soft phase as described above, Patent Literature 1 discloses a heat treatment method in which quenching (Q') from the two-phase, ($\gamma+\alpha$) temperature range of ferrite and austenite is performed between quenching (Q) and tempering (T).

As for methods in which the number of manufacturing steps is not increased, Patent Literature 2 discloses a method in which after rolling is finished at the $Ar_3$ transformation temperature or higher, the start of accelerated cooling is delayed until the temperature of a steel material decreases to or below the $Ar_3$ transformation temperature, at which ferrite is produced.

As for techniques for achieving low yield ratio without performing such heat treatment as disclosed in Patent Literature 1 or 2, Patent Literature 3 discloses a method in which low yield ratio is achieved in such a manner that after the rolling of a steel material is finished at the $Ar_3$ transformation temperature or higher, the rate of accelerated cooling and the finishing cooling temperature are controlled such that a two-phase microstructure consisting of acicular ferrite and martensite is produced.

Furthermore, as for techniques for achieving low yield ratio and excellent welded heat affected zone (HAZ) toughness, Patent Literature 4 discloses a method in which a three-phase microstructure consisting of ferrite, bainite, and Martensite-Austenite constituent (island martensite, Martensitic Islands or M-A constituent, hereinafter called M-A constituent) is produced in such a manner that Ti/N and/or the Ca—O—S balance is controlled.

Patent Literature 5 discloses a technique in which low yield ratio and high uniform elongation are achieved by the addition of an alloying element such as Cu, Ni, or Mo.

On the other hand, welded steel pipes such as UOE steel pipes used for line pipes and electric welded tubes are manufactured in such a manner that steel plates are cold-formed into pipes, abutting surfaces thereof are welded, and the outer surfaces of the tubes are usually subjected to coating such as polyethylene coating or powder epoxy coating in view of corrosion resistance. Therefore, there is a problem in that the steel pipes have a yield ratio greater than the yield ratio of the steel plates because strain ageing is caused by the strain during pipe making and the heat during coating and the yield stress is increased. In order to cope with such a problem, Patent Literatures 6 and 7 each disclose a steel pipe which has excellent strain ageing resistance, low yield ratio, high strength, and high toughness and which makes use of fine precipitates of composite carbides containing Ti and Mo or fine precipitates of composite carbides containing two or more of Ti, Nb, and V and also disclose a method for manufacturing the steelpipe.

PATENT LITERATURE

PTL 1: Japanese Unexamined Patent Application Publication No. 55-97425

PTL 2: Japanese Unexamined Patent Application Publication No. 55-41927

PTL 3: Japanese Unexamined Patent Application Publication No. 1-176027

PTL 4: Japanese Patent No. 4066905 (Japanese Unexamined Patent Application Publication No. 2005-48224)

PTL 5: Japanese Unexamined Patent Application Publication No. 2008-248328

PTL 6: Japanese Unexamined Patent Application Publication No. 2005-60839

PTL 7: Japanese Unexamined Patent Application Publication No. 2005-60840

SUMMARY OF THE INVENTION

The heat treatment method disclosed in Patent Literature 1 is capable of achieving low yield ratio by appropriately selecting the quenching temperature of the two-phase, ($\gamma+\alpha$) temperature range and, however, includes an increased number of heat treatment steps. Therefore, there is a problem in that a reduction in productivity and an increase in manufacturing cost are caused.

In the technique disclosed in Patent Literature 2, cooling needs to be performed at a cooling rate close to a natural cooling rate in the temperature range from the end of rolling to the start of accelerated cooling. Therefore, there is a problem in that productivity is extremely low.

In the technique disclosed in Patent Literature 3, in order to allow the steel material to have a tensile strength of 490 $N/mm^2$ (50 $kg/mm^2$) or more as described in an example, the steel material needs to have an increased carbon content or a composition in which the amount of an added alloying element is increased, which causes an increase in material cost and a problem in that the toughness of a welded heat affected zone is deteriorated.

In the technique disclosed in Patent Literature 4, the influence of a microstructure on the uniform elongation performance required for use in pipelines has not necessarily become clear. The low-temperature toughness of a base material has been evaluated at −10° C. only and therefore it is unclear whether the base material can be used in novel applications in which toughness is required at lower temperature.

In the technique disclosed in Patent Literature 5, a composition in which the additive amount of an alloying element is increased is required, which causes an increase in material cost and a problem in that the toughness of a welded heat affected zone is deteriorated. A base material and the welded heat affected zone have been evaluated for low-temperature toughness only at −10° C.

In the technique disclosed in Patent Literature 6 or 7, a base material and a welded heat affected zone have been evaluated for low-temperature toughness only at −10° C., though strain ageing resistance is improved.

In Patent Literatures 1 to 7, a ferrite phase is essential. When the ferrite phase is contained, an increase in strength to X60 or higher according to API standards causes a reduction in tensile strength and the amount of an alloying element needs to be increased in order to secure strength, which may possibly cause an increase in alloying cost and a reduction in low-temperature toughness.

Embodiments of the present invention provide a low yield ratio, high strength and high toughness steel plate and a method for manufacturing the same. The low yield ratio, high strength and high toughness steel plate is capable of solving such problems with conventional techniques and has excellent strain ageing resistance equivalent to API 5L X60 Grade or higher (herein, particularly X65 and X70 Grades).

In order to solve the above problems, the inventors have intensively investigated methods for manufacturing steel plates, particularly manufacturing processes including controlled rolling, accelerated cooling subsequent to controlled rolling, and reheating subsequent thereto. As a result, the inventors have obtained findings below.

(a) Cooling is stopped in a temperature range in which non-transformed austenite is present, that is, during bainite transformation, in the course of accelerated cooling and reheating is started at a temperature higher than the bainite transformation finish temperature (hereinafter referred to as the Bf point), whereby the metallographic microstructure of a steel plate is transformed into a microstructure in which hard M-A constituent (hereinafter referred to as MA) is uniformly produced in a two-phase mixture of quasi-polygonal ferrites and bainite and therefore low yield ratio can be achieved. The term "quasi-polygonal ferrites" as used herein refers to αq structures shown in Bainite Committee of The Iron and Steel Institute of Japan, *Atlas for Bainitic Microstructures* (1992). The quasi-polygonal ferrites are produced at a lower temperature as compared to polygonal ferrites (αP) and are characterized in that the quasi-polygonal ferrites are not equiaxed grains like polygonal ferrites but are grains with an irregular changeful shape.

The reduction of strength can be suppressed without impairing deformation properties such as elongation by making use of the quasi-polygonal ferrites, which are produced at a lower temperature as compared to an ordinary ferrite phase (also called a polygonal ferrite phase in a narrow sense) disclosed in Patent Literatures 1 to 7. Ferrite hereinafter refers to polygonal ferrite unless otherwise specified.

MA can be readily identified in such a manner that a steel plate is etched with, for example, 3% nital (a solution of nitric acid in alcohol), is subjected to electrolytic etching, and is then observed. MA is observed as a white prominent portion when a steel plate is observed with a scanning electron microscope (SEM).

(b) Since the addition of an appropriate amount of Mn, which is an austenite stabilizing element, stabilizes non-transformed austenite, hard MA can be produced without the addition of a large amount of a hardenability-improving element such as Cu, Ni, or Mo.

(c) MA can be uniformly and finely dispersed and the uniform elongation can be improved with the yield ratio maintained low by applying an accumulative rolling reduction of 50% or more in a no-recrystallization temperature range in austenite not higher than 900° C.

(d) Furthermore, the shape of MA can be controlled, that is, MA can be refined to an average equivalent circle diameter of 3.0 μm or less, by controlling rolling conditions in the no-recrystallization temperature range in austenite described in Item (c) and the reheating conditions described in Item (a). As a result, the decomposition of MA is slight even though such a thermal history that causes the deterioration in yield ratio of conventional steels is suffered; hence, desired type of metallographic microstructure and properties can be maintained after ageing.

The present invention has been made on the basis of the above findings and additional studies. Exemplary embodiments of the present invention are described below.

A first embodiment of the invention is a low yield ratio, high strength and high toughness steel plate having excellent strain ageing resistance. The steel plate has a composition containing 0.03% to 0.06% C, 0.01% to 1.0% Si, 1.2% to 3.0% Mn, 0.015% or less P, 0.005% or less S, 0.08% or less Al, 0.005% to 0.07% Nb, 0.005% to 0.025% Ti, 0.010% or less N, and 0.005% or less O on a mass basis, the remainder being Fe and unavoidable impurities. The steel plate has a metallographic microstructure that is a three-phase microstructure consisting of bainite, M-A constituent, and quasi-polygonal ferrite, the area fraction of the bainite being 5% to 70%, the area fraction of the M-A constituent being 3% to 20%, the remainder being the quasi-polygonal ferrite, the equivalent circle diameter of the M-A constituent being 3.0 μm or less. The steel plate has a yield ratio of 85% or less and a Charpy impact test absorbed energy of 200 J or more at −30° C. The steel plate has a yield ratio of 85% or less and a Charpy impact test absorbed energy of 200 J or more at −30° C. after being subjected to strain ageing treatment at a temperature of 250° C. or lower for 30 minutes or less.

A second embodiment of the invention is the low yield ratio, high strength and high toughness steel plate having excellent strain ageing resistance, according to the first embodiment, further containing one or more selected from the group consisting of 0.5% or less Cu, 1% or less Ni, 0.5% or less Cr, 0.5% or less Mo, 0.1% or less V, 0.0005% to 0.003% Ca, and 0.005% or less B on a mass basis.

A third embodiment of the invention is the steel plate, according to the first or second embodiment, further having a uniform elongation of 6% or more and also having a uniform elongation of 6% or more after being subjected to strain ageing treatment at a temperature of 250° C. or lower for 30 minutes or less.

A fourth embodiment of the invention is a method for manufacturing a low yield ratio, high strength and high toughness steel plate having excellent strain ageing resistance. The method includes heating steel having the composition according to any one of the first to third embodiments to a temperature of 1000° C. to 1300° C., hot-rolling the steel at a finishing rolling temperature not lower than the $Ar_a$ transformation temperature such that the accumulative rolling reduction at 900° C. or lower is 50% or more, performing accelerated cooling to a temperature of 500° C. to 680° C. at a cooling rate of 5° C./s or more, and immediately performing reheating to a temperature of 550° C. to 750° C. at a heating rate of 2.0° C./s or more.

According to exemplary embodiments of the present invention, a low yield ratio, high strength and high toughness steel plate having excellent strain ageing resistance can be manufactured at low cost without deteriorating the toughness of a welded heat affected zone or adding a large amount of an alloying element. Therefore, a large number of steel plates mainly used for line pipes can be stably manufactured at low cost and productivity and economic efficiency can be significantly increased, which is extremely industrially advantageous.

DETAILED DESCRIPTION OF THE INVENTION

Figure 1:
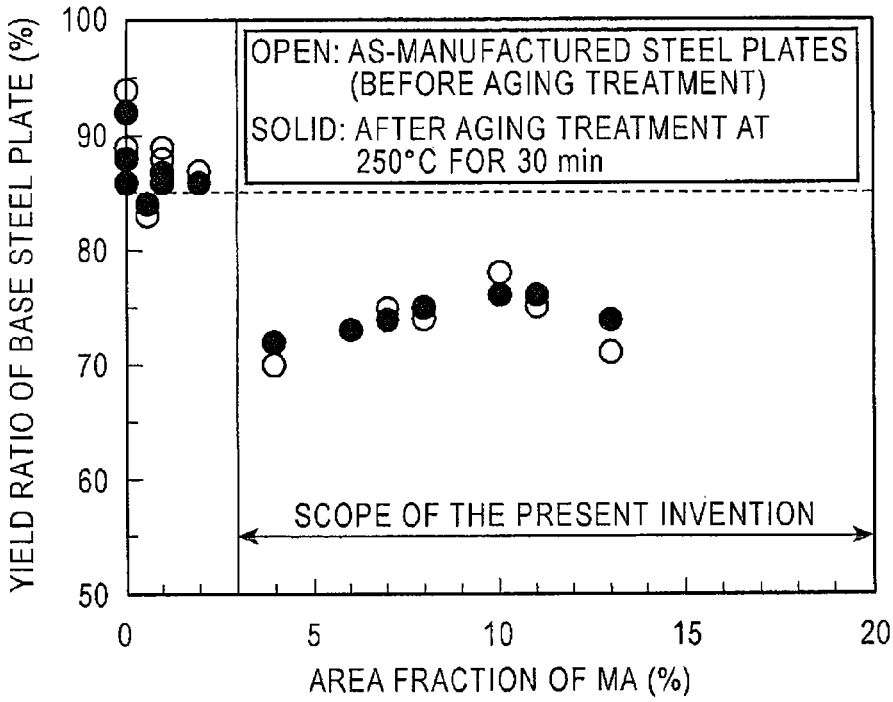
FIG. 1 is a graph showing the relationship between the area fraction of MA and the yield ratio of base materials.

Reasons for limiting components of the present invention are described below.

1. Composition

Reasons for limiting the composition of steel according to aspects of the present invention are first described. Herein, % of each component refers to mass percent.

C: 0.03% to 0.06%

C is an element which contributes to precipitation hardening in the form of carbides and which is important in producing MA. The addition of less than 0.03% C is insufficient to produce MA and therefore sufficient strength cannot possibly be ensured. The addition of more than 0.06% C deteriorates the toughness of a base material and the toughness of a welded heat affected zone (HAZ). Therefore, the content of C is within the range of 0.03% to 0.06%. The content thereof is preferably within the range of 0.04% to 0.06%.

Si: 0.01% to 1.0%

Si is used for deoxidation. The addition of less than 0.01% Si is insufficient to obtain a deoxidation effect. The addition of more than 1.0% Si causes the deterioration of toughness and weldability. Therefore, the content of Si is within the range of 0.01% to 1.0%. The content thereof is preferably within the range of 0.01% to 0.3%.

Mn: 1.2% to 3.0%

Mn is added for the improvement of strength, toughness, and hardenability to promote the production of MA. The addition of less than 1.2% Mn is insufficient to obtain such an effect. The addition of more than 3.0% Mn causes the deterioration of toughness and weldability. Therefore, the content of Mn is within the range of 1.2% to 3.0%. In order to stably produce MA independently of the variation of components and manufacturing conditions, the content thereof is preferably 1.8% or more.

P and S: 0.015% or less and 0.005% or less, respectively

According to aspects of the present invention, P and S are unavoidable impurities and therefore the upper limits of the contents thereof are limited. A high P content causes significant center segregation to deteriorate the toughness of the base material; hence, the content of P is 0.015% or less. A high S content causes a significant increase in production of MnS to deteriorate the toughness of the base material; hence, the content of S is 0.005% or less. The content of P is preferably 0.010% or less. The content of S is preferably 0.002% or less.

Al: 0.08% or less

Al is added as a deoxidizing agent. The addition of less than 0.01% Al is insufficient to obtain a deoxidation effect. The addition of more than 0.08% Al causes a decrease in cleanliness and a reduction in toughness of the steel. Therefore, the content of Al is 0.08% or less. The content thereof is preferably within the range of 0.01% to 0.08% and more preferably 0.01% to 0.05%.

Nb: 0.005% to 0.07%

Nb is an element which contributes to the increase of toughness due to the refining of a microstructure and also contributes to the increase of strength due to an increase in hardenability of solute Nb. Such effects are achieved by the addition of 0.005% or more Nb. However, the addition of less than 0.005% Nb is ineffective. The addition of more than 0.07% Nb deteriorates the toughness of the welded heat affected zone. Therefore, the content of Nb is within the range of 0.005% to 0.07%. The content thereof is preferably within the range of 0.01% to 0.05%.

Ti: 0.005% to 0.025%

Ti is an important element which suppresses the coarsening of austenite during the heating of a slab by a pinning effect to increase the toughness of the base material. Such an effect is achieved by the addition of 0.005% or more Ti. However, the addition of more than 0.025% Ti deteriorates the toughness of the welded heat affected zone. Therefore, the content of Ti is within the range of 0.005% to 0.025%. In view of the toughness of the welded heat affected zone, the content of Ti is preferably within the range of 0.005% to less than 0.02% and more preferably 0.007% to 0.016%.

N: 0.010% or less

N is treated as an unavoidable impurity. When the content of N is more than 0.010%, the toughness of the welded heat affected zone is deteriorated. Therefore, the content of N is 0.010% or less. The content thereof is preferably 0.007% or less and more preferably 0.006% or less.

O: 0.005% or less

According to aspects of the present invention, O is an unavoidable impurity and therefore the upper limit of the content thereof is limited. O is a cause of the production of coarse inclusions adversely affecting toughness. Therefore, the content of O is 0.005% or less. The content thereof is preferably 0.003% or less.

Those described above are preferred components in the present invention. For the purposes of improving the strength and toughness of the steel plate, enhancing the hardenability thereof, and promoting the production of MA, one or more of Cu, Ni, Cr, Mo, V, Ca, and B may be contained therein.

Cu: 0.5% or less

Cu need not be added. However, Cu may be added because the addition thereof contributes to the enhancement of the hardenability of the steel. In order to obtain such an effect, the addition of 0.05% or more Cu is preferred.

However, the addition of 0.5% or more Cu causes the deterioration of toughness. Therefore, in the case of adding Cu, the content of Cu is preferably 0.5% or less and more preferably 0.4% or less.

Ni: 1% or less

Ni need not be added. However, Ni may be added because the addition thereof contributes to the enhancement of the hardenability of the steel and the addition a large amount thereof does not cause the deterioration of toughness but is effective in strengthening. In order to obtain such effects, the addition of 0.05% or more Ni is preferred. However, the content of Ni is preferably 1% or less and more preferably 0.4% or less in the case of adding Ni because Ni is an expensive element.

Cr: 0.5% or less

Cr need not be added. However, Cr may be added because Cr, as well as Mn, is an element effective in obtaining sufficient strength even if the content of C is low. In order to obtain such an effect, the addition of 0.1% or more Cr is preferred. However, the excessive addition thereof causes the deterioration of weldability. Therefore, in the case of adding Cr, the content of Cr is preferably 0.5% or less and more preferably 0.4% or less.

Mo: 0.5% or less

Mo need not be added. However, Mo may be added because Mo is an element which enhances the hardenability and which produces MA and strengthens a bainite phase to contribute to the increase of strength. In order to obtain such effects, the addition of 0.05% or more Mo is preferred. However, the addition of more than 0.5% Mo causes the deterioration in toughness of the welded heat affected zone. Therefore, in the case of adding Mo, the content of Mo is preferably 0.5% or less. In view of the toughness of the welded heat affected zone, the content of Mo is preferably 0.3% or less.

V: 0.1% or less

V need not be added. However, V may be added because V is an element which enhances the hardenability and which contributes to the increase of the strength. In order to obtain such effects, the addition of 0.005% or more V is preferred. However, the addition of more than 0.1% V causes the deterioration in toughness of the welded heat affected zone. Therefore, in the case of adding V, the content of V is preferably 0.1% or less and more preferably 0.06% or less.

Ca: 0.0005% to 0.003% Ca controls the morphology of sulfide inclusions to improve the toughness and therefore may be added. When the content thereof is 0.0005% or more, such an effect is achieved. When the content thereof is more than 0.003%, the effect is saturated, the cleanliness is reduced, and the toughness is deteriorated. Therefore, in the case of adding Ca, the content of Ca is preferably in the range of 0.0005% to 0.003% and more preferably 0.001% to 0.003%.

B: 0.005% or less

B may be added because B is an element contributing to the improvement in toughness of the welded heat affected zone (HAZ). In order to obtain such an effect, the addition of 0.0005% or more B is preferred. However, the addition of more than 0.005% B causes the deterioration of weldability. Therefore, in the case of adding B, the content of B is preferably 0.005% or less and more preferably 0.003% or less.

The optimization of the ratio Ti/N that is the ratio of the content of Ti to the content of N allows the coarsening of austenite in the welded heat affected zone to be suppressed due to TiN grains and allows the welded heat affected zone to have good toughness. Therefore, the ratio Ti/N is preferably within the range of 2 to 8 and more preferably 2 to 5.

The remainder, other than the above components of the steel plate according to aspects of the present invention, is Fe and unavoidable impurities. It is not denied that an element other than those described above may be contained therein, unless advantageous effects of the present invention are impaired. In view of the improvement of toughness, for example, 0.02% or less Mg and/or 0.02% or less of a REM (rare-earth metal) may be contained therein.

A metallographic microstructure according to an exemplary embodiment of the present invention is described below.

2. Metallographic Microstructure

In an exemplary embodiment of the present invention, the metallographic microstructure uniformly contains 5% to 70% bainite and 3% to 20% M-A constituent (MA) on an area fraction basis, the remainder being quasi-polygonal ferrite.

The reduction of yield ratio, the increase of uniform elongation, and the improvement of low-temperature toughness are accomplished by producing a three-phase microstructure in which quasi-polygonal ferrite, bainite, and MA are uniformly produced, that is, a composite microstructure containing soft quasi-polygonal ferrite, bainite, and hard MA.

In view of ensuring the strength, the area fraction of quasi-polygonal ferrite is preferably 10% or more. In view of ensuring the toughness of the base material, the area fraction of bainite is preferably 5% or more.

For applications to earthquake zones suffering large deformation, high uniform elongation is required in addition to low yield ratio in some cases. In the composite microstructure, which contains soft quasi-polygonal ferrite, bainite, and hard MA, a soft phase suffers deformation and therefore a uniform elongation of 6% or more can be achieved. The uniform elongation is preferably 7% or more and more preferably 10% or more.

The percentage of MA in the microstructure is 3% to 20% in terms of the area fraction (calculated from the average of the percentages of the areas of MA in arbitrary cross sections of the steel plate in the rolling direction thereof, the thickness direction thereof, and the like) of MA. An MA area fraction of less than 3% is insufficient to achieve low yield ratio in some cases and an MA area fraction of more than 20% causes the deterioration in toughness of the base material in some cases. FIG. 1 shows the relationship between the area fraction of MA and the yield ratio of base materials. It is clear that achieving a yield ratio of 85% or less is difficult when the area fraction of MA is less than 3%.

Figure 2:
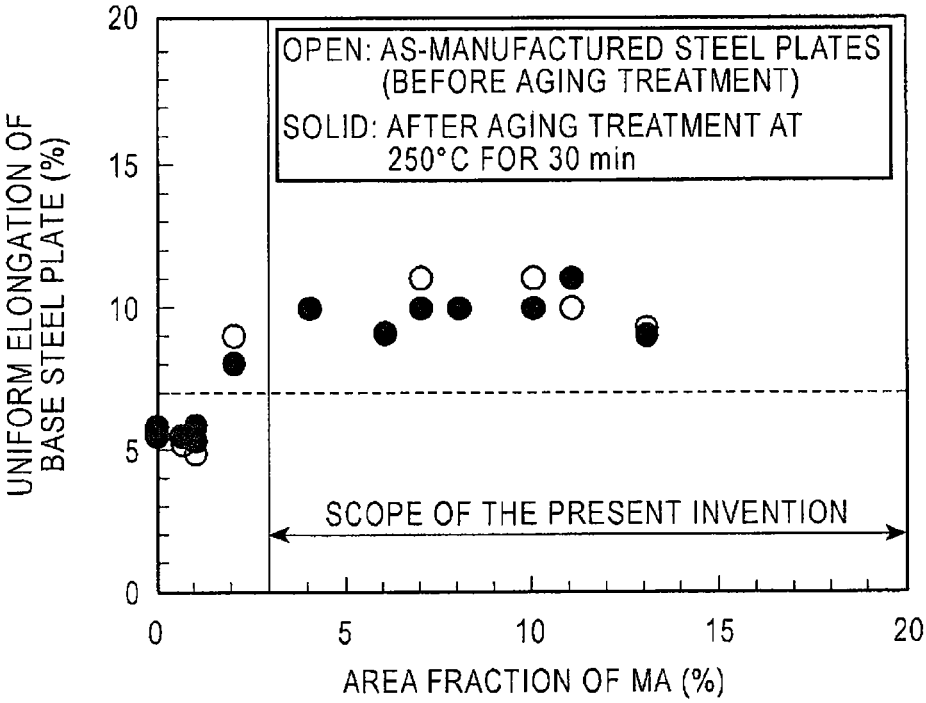
FIG. 2 is a graph showing the relationship between the area fraction of MA and the uniform elongation of base materials.

In view of the reduction of yield ratio and the increase of uniform elongation, the area fraction of MA is preferably 5% to 15%. FIG. 2 shows the relationship between the area fraction of MA and the uniform elongation of base materials. It is difficult to achieve a uniform elongation of 6% or more when the area fraction of MA is less than 3%.

The area fraction of MA can be calculated from the average of the percentages of the areas of MA in microstructure photographs of at least four fields or more of view, the photographs being obtained by SEM (scanning electron microscope) observation and being subjected to image processing.

Figure 3:
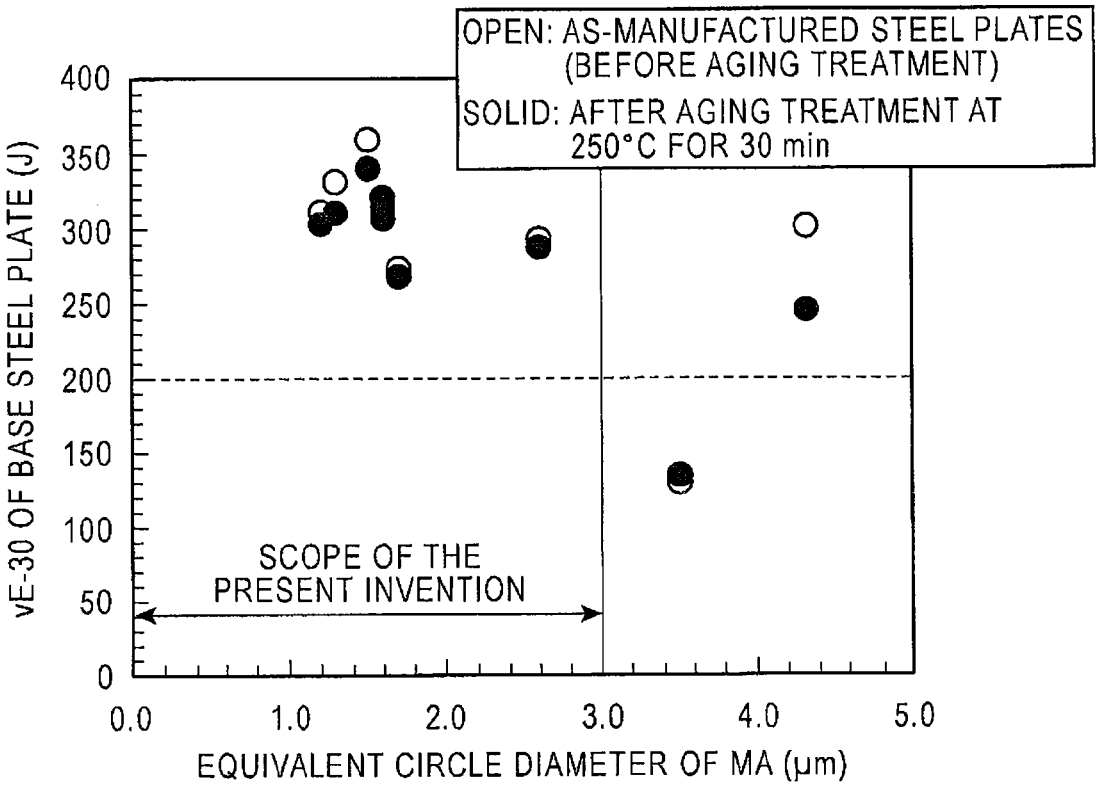
FIG. 3 is a graph showing the relationship between the equivalent circle diameter of MA and the toughness of base materials.

In view of ensuring the toughness of the base material, the equivalent circle diameter of MA is 3.0 μm or less. FIG. 3 shows the relationship between the equivalent circle diameter of MA and the toughness of base materials. It is difficult to allow the Charpy impact test absorbed energy of a base material to be 200 J or more at −30° C. when the equivalent circle diameter of MA is less than 3.0 μm.

The equivalent circle diameter of MA can be determined in such a manner that a microstructure photograph obtained by SEM observation is subjected to image processing and the diameters of circles equal in area to individual MA grains are determined and are then averaged.

According to aspects of the present invention, in order to produce MA without adding a large amount of an expensive alloying element such as Cu, Ni, or Mo, it is important that non-transformed austenite is stabilized by the addition of Mn and Si, reheating is performed, and pearlitic transformation and cementite precipitation are suppressed during subsequent air cooling.

In view of suppressing ferrite precipitation, the initial cooling temperature is preferably not lower than the $Ar_3$ transformation temperature.

In an exemplary embodiment of the present invention, the mechanism of MA production is as described below. Detailed manufacturing conditions are described below.

After a slab is heated, rolling is finished in the austenite region and accelerated cooling is started at the $Ar_3$ transformation temperature or higher.

In the following process, the change of the microstructure is as described below: a manufacturing process in which accelerated cooling is finished during bainite transformation, that is, in a temperature range in which non-transformed austenite is present, reheating is performed at a temperature higher than the finish temperature (Bf point) of bainite transformation, and cooling is then performed.

The microstructure contains bainite, quasi-polygonal ferrite, and non-transformed austenite at the end of accelerated cooling. Reheating is performed at a temperature higher than the Bf point, whereby non-transformed austenite is transformed into bainite and quasi-polygonal ferrite. Since the maximum amount of solid solution of carbon in each of bainite and quasi-polygonal ferrite is small, C is emitted in surrounding non-transformed austenite.

Therefore, the amount of C in non-transformed austenite increases as bainite transformation and quasi-polygonal ferrite transformation proceed during reheating. When certain amounts of Cu, Ni, and the like, which are austenite stabilizing elements, are contained, non-transformed austenite in which C is concentrated remains at the end of reheating and is then transformed into MA by cooling subsequent to reheating. A microstructure in which MA is produced in a two-phase microstructure consisting of bainite and quasi-polygonal ferrite is formed.

According to aspects of the present invention, it is important that reheating is performed subsequently to accelerated cooling in a temperature range in which non-transformed austenite is present. When the initial reheating temperature is not higher than the Bf point, bainite transformation and quasi-polygonal ferrite transformation are completed and non-transformed austenite is not present. Therefore, the initial reheating temperature needs to be higher than the Bf point.

Cooling subsequent to reheating is not limited and is preferably air cooling so as not to affect the transformation of MA. In an exemplary embodiment of the present invention, steel containing a certain amount of Mn is used, accelerated cooling is stopped during bainite transformation and quasi-polygonal ferrite transformation, and continuous reheating is immediately performed, whereby hard MA can be produced without reducing manufacturing efficiency.

The steel according to an exemplary embodiment of the present invention has the metallographic microstructure, which uniformly contains a certain amount of MA in addition to two phases: quasi-polygonal ferrite and bainite. Those containing another microstructure or another precipitate are included in the scope of the present invention unless advantageous effects of the present invention are impaired.

In particular, when one or more of ferrite, pearlite, cementite, and the like coexist, the strength is reduced. However, when the area fraction of a microstructure other than quasi-polygonal ferrite, bainite, and MA is small, a reduction in strength is negligible. Therefore, a metallographic microstructure other than quasi-polygonal ferrite, bainite, and MA, that is, one or more of ferrite (particularly polygonal ferrite), pearlite, cementite, and the like may be contained when the area fraction thereof in the microstructure is 3% or less in total.

The above-mentioned metallographic microstructure can be obtained in such a manner that the steel having the above-mentioned composition is manufactured by a method below.

3. Manufacturing Conditions

It is preferred that the steel having the above-mentioned composition is produced in a production unit such as a steel converter or an electric furnace in accordance with common practice and is then processed into a steel material such as a slab by continuous casting or ingot casting-blooming in accordance with common practice. A production process and a casting process are not limited to the above processes. The steel material is rolled so as to have desired properties and a desired shape, is cooled subsequently to rolling, and is then heated.

In an exemplary embodiment of the present invention, each of the temperatures such as the heating temperature, the finishing rolling temperature, the finishing cooling temperature, and the reheating temperature is the average temperature of the steel plate. The average temperature thereof is determined from the surface temperature of a slab or the steel plate by calculation in consideration of a parameter such as thickness and thermal conductivity. The cooling rate is the average obtained by dividing the temperature difference required for cooling to a finishing cooling temperature (500° C. to 680° C.) by the time taken to perform cooling after hot rolling is finished.

The heating rate is the average obtained by dividing the temperature difference required for reheating to a reheating temperature (550° C. to 750° C.) by the time taken to perform reheating after cooling. Each manufacturing condition is described below in detail.

The $Ar_3$ transformation temperature used is a value calculated by the following equation:

$$Ar_3(^\circ C.)=910-310C-80Mn-20Cu-15Cr-55Ni-80Mo.$$

Heating temperature: 1000° C. to 1300° C.

When the heating temperature is lower than 1000° C., the solid solution of carbides is insufficient and required strength cannot be achieved. When the heating temperature is higher than 1300° C., the toughness of the base material is deteriorated. Therefore, the heating temperature is within the range of 1000° C. to 1300° C.

Finishing rolling temperature: not lower than $Ar_3$ transformation temperature

When the finishing rolling temperature is lower than the $Ar_3$ transformation temperature, the concentration of C in non-transformed austenite is insufficient during reheating and therefore MA is not produced because the transformation rate of ferrite is reduced. Therefore, the finishing rolling temperature is not lower than the $Ar_3$ transformation temperature.

Accumulative rolling reduction at 900° C. or lower: 50% or more

This condition is one of important manufacturing conditions. A temperature range not higher than 900° C. corresponds to the no-recrystallization temperature range in austenite. When the accumulative rolling reduction in this temperature, range is 50% or more, austenite grains can be refined and therefore the number of sites producing MA at prior austenite grain boundaries is increased, which contributes to suppressing the coarsening of MA.

When the accumulative rolling reduction at 900° C. or lower is less than 50%, the uniform elongation is reduced or the toughness of the base material is reduced in some cases because the equivalent circle diameter of produced MA exceeds 3.0 μm. Therefore, the accumulative rolling reduction at 900° C. or lower is 50% or more.

Cooling rate and finishing cooling temperature: 5° C./s or more and 500° C. to 680° C., respectively Accelerated cooling is performed immediately after rolling is finished. In the case where the initial cooling temperature is not higher than the $Ar_3$ transformation temperature and therefore polygonal ferrite is produced, a reduction in strength is caused and MA is unlikely to be produced. Therefore, the initial cooling temperature is preferably not lower than the $Ar_3$ transformation temperature.

The cooling rate is 5° C./s or more. When the cooling rate is less than 5° C./s, pearlite is produced during cooling and therefore sufficient strength or low yield ratio cannot be achieved. Therefore, the cooling rate after rolling is 5° C./s or more.

In an exemplary embodiment of the present invention, supercooling is performed to a bainite and quasi-polygonal ferrite transformation region by accelerated cooling, whereby bainite transformation and quasi-polygonal ferrite transformation can be completed during reheating without temperature keeping during reheating.

The finishing cooling temperature is 500° C. to 680° C. In an exemplary embodiment of the present invention, this process is an important manufacturing condition. In an exemplary embodiment, non-transformed austenite in which C present after reheating is concentrated is transformed into MA during air cooling.

That is, cooling needs to be finished in a temperature range in which non-transformed austenite that is being transformed into bainite and quasi-polygonal ferrite is present. When the finishing cooling temperature is lower than 500° C., bainite transformation and quasi-polygonal ferrite transformation are completed; hence, MA is not produced during cooling and therefore low yield ratio cannot be achieved. When the finishing cooling temperature is higher than 680° C., C is consumed by pearlite precipitated during cooling and therefore MA is not produced. Therefore, the finishing cooling temperature is 500° C. to 680° C. In order to ensure the area fraction of MA that is preferable in achieving better strength and toughness, the finishing cooling temperature is preferably 550° C. to 660° C. An arbitrary cooling system can be used for accelerated cooling.

Heating rate after accelerated cooling and reheating temperature: 2.0° C./s or more and 550° C. to 750° C., respectively Reheating is performed to a temperature of 550° C. to 750° C. at a heating rate of 2.0° C./s or more immediately after accelerated cooling is finished.

The expression "reheating is performed immediately after accelerated cooling is finished" as used herein means that reheating is performed a heating rate of 2.0° C./s or more within 120 seconds after accelerated cooling is finished.

In an exemplary embodiment of the present invention, this process is an important manufacturing condition. Non-transformed austenite is transformed into bainite and quasi-polygonal ferrite during reheating subsequent to accelerated cooling and therefore C is emitted in remaining non-transformed austenite. The non-transformed austenite in which C is concentrated is transformed into MA during air cooling subsequent to reheating.

In order to obtain MA, reheating needs to be performed from a temperature higher than the Bf point to a temperature of 550° C. to 750° C. after accelerated cooling.

When the heating rate is less than 2.0° C./s, it takes a long time to achieve a target heating temperature and therefore manufacturing efficiency is low. Furthermore, the coarsening of MA is caused in some cases and low yield ratio, sufficient toughness, or sufficient uniform elongation cannot be achieved. This mechanism is not necessarily clear but is believed to be that the coarsening of a C-concentrated region is suppressed and the coarsening of MA produced during cooling subsequent to reheating is suppressed by increasing the heating rate during reheating to 2.0° C./s or more.

When the reheating temperature is lower than 550° C., bainite transformation or quasi-polygonal ferrite transformation does not occur sufficiently and the emission of C in non-transformed austenite is insufficient; hence, MA is not produced or low yield ratio cannot be achieved. When the reheating temperature is higher than 750° C., sufficient strength cannot be achieved because of the softening of bainite. Therefore, the reheating temperature is within the range of 550° C. to 750° C.

In an exemplary embodiment of the present invention, it is important to perform reheating subsequent to accelerated cooling from a temperature range in which non-transformed austenite is present. When the initial reheating temperature is not higher than the Bf point, bainite transformation and quasi-polygonal ferrite transformation are completed and therefore non-transformed austenite is not present. Therefore, the initial reheating temperature needs to be higher than the Bf point.

In order to securely concentrate C, which causes bainite transformation and quasi-polygonal ferrite transformation, in non-transformed austenite, the reheating temperature is preferably increased by 50° C. or more than initial reheating temperature. The temperature-maintaining time need not be particularly set at the initial reheating temperature.

Since MA is sufficiently obtained by a manufacturing method according to an exemplary embodiment of the present invention even cooling is performed immediately after reheating, low yield ratio and high uniform elongation can be achieved. However, in order to promote the diffusion of C to ensure the area fraction of MA, temperature keeping may be performed for 30 minutes or less during reheating.

If temperature keeping is performed for more than 30 minutes, then recovery occurs in a bainite phase to cause a reduction in strength in some cases. The cooling rate after reheating is preferably equal to the rate of air cooling.

In order to perform reheating subsequently to accelerated cooling, a heater may be placed downstream of a cooling system for performing accelerated cooling. The heater used is preferably a gas burner furnace of induction heating apparatus capable of rapidly heating the steel plate.

As described above, in an exemplary embodiment of the present invention, the number of the MA-producing sites can be increased through the refining of the austenite grains, MA can be uniformly and finely dispersed, and the Charpy impact test absorbed energy at −30° C. can be increased to 200 J or more with a low yield ratio of 85% or less maintained by applying an accumulative rolling reduction of 50% or more in a no-recrystallization temperature range in austenite not higher than 900° C. Furthermore, in an exemplary embodiment of the present invention, since the coarsening of MA is suppressed by increasing the heating rate during reheating subsequent to accelerated cooling, the equivalent circle diameter of MA can be reduced 3.0 μm or less. Furthermore, a uniform elongation of 6% or more can be achieved.

This allows the decomposition of MA in the steel according to an exemplary embodiment of the present invention to be suppressed and a predetermined metallographic microstructure that is a three-phase microstructure consisting of bainite, MA, and quasi-polygonal ferrite to be maintained even if the steel suffers such a thermal history that deteriorates properties of conventional steels because of strain ageing. As a result, in an exemplary embodiment of the present invention, an increase in yield strength (YS) due to strain ageing, an increase in yield ratio due to that, and a reduction in uniform elongation can be suppressed even through a thermal history corresponding to heating at 250° C. for 30 minutes, that is, heating at high temperature for a long time in a coating process for common steel tubes. In the steel according to an exemplary embodiment of the present invention, a yield ratio of 850 or less, a Charpy impact test absorbed energy of 200 J or more at −30° C. can be ensured even if the steel suffers such a thermal history that deteriorates properties of conventional steels because of strain ageing. Furthermore, a uniform elongation of 6% or more can be achieved.

Example 1

Steels (Steels A to J) having compositions shown in Table 1 were processed into slabs by continuous casting and steel plates (Nos. 1 to 16) with a thickness of 20 mm or 33 mm were manufactured from the slabs.

Each heated slab was hot-rolled, was immediately cooled in an accelerated cooling system of a water-cooled type, and was then reheated in an induction heating furnace or a gas burner furnace. The induction heating furnace and the accelerated cooling system were arranged on the same line.

Conditions for manufacturing the steel plates (Nos. 1 to 16) are shown in Table 2. Temperatures such as the heating temperature, the finishing rolling temperature, the final (finishing) cooling temperature, and the reheating temperature were the average temperatures of the steel plates. The average temperature was determined from the surface temperature of each slab or steel plate by calculation using a parameter such as thickness and thermal conductivity.

The cooling rate is the average obtained by dividing the temperature difference required for cooling to a final (finishing) cooling temperature (460° C. to 630° C.) by the time taken to perform cooling after hot rolling is finished. The reheating rate (heating rate) is the average obtained by dividing the temperature difference required for reheating to a reheating temperature (530° C. to 680° C.) by the time taken to perform reheating after cooling.

The steel plates manufactured as described above were measured for mechanical property. The measurement results are shown in Table 3. The tensile strength was evaluated from the average thereof in such a manner that two tension test specimens were taken from each steel plate in a direction perpendicular to the rolling direction thereof so as to have the same thickness as that of the steel plate and were subjected to a tension test.

A tensile strength of 517 MPa or more (API 5L X60 or higher) was defined as the preferred strength in the present invention. The yield ratio and the uniform elongation were each evaluated from the average thereof in such a manner that two tension test specimens were taken from the steel plate in the rolling direction thereof so as to have the same thickness as that of the steel plate and were subjected to a tension test. A yield ratio of 85% or less and a uniform elongation of 6% or more were preferred deformation properties in the present invention.

For the toughness of each base material, three full-size Charpy impact test V-notch specimens were taken therefrom in a direction perpendicular to the rolling direction, were subjected to a Charpy impact test, and were measured for absorbed energy at −30° C. and the average thereof was determined. Those having an absorbed energy of 200 J or more at −30° C. were judged to be good.

For the toughness of each welded heat affected zone (HAZ), three specimens to which a thermal history corresponding to a heat input of 40 kJ/cm was applied with a reproducing apparatus of weld thermal cycles were taken and were subjected to a Charpy impact test. These specimens were measured for absorbed energy at −30° C. and the average thereof was determined. Those having an absorbed energy of 100 J or more at −30° C. were judged to be good.

After the manufactured steel plates were subjected to strain ageing treatment by maintaining the steel plates at 250° C. for 30 minutes, the base materials were subjected to the tension test and the Charpy impact test and the welded heat affected zones (HAZ) were also subjected to the Charpy impact test, followed by evaluation. Evaluation standards after strain ageing treatment were the same as the above-mentioned evaluation standards before strain ageing treatment.

As shown in Table 3, the compositions and manufacturing methods of Nos. 1 to 7, which are examples of the present invention, are within the scope of preferred embodiments of the present invention; Nos. 1 to 7 have a high tensile strength of 517 MPa or more, a low yield ratio of 85% or less, and a high uniform elongation of 6% or more before and after strain ageing treatment at 250° C. for 30 minutes; and the base materials and the welded heat affected zones have good toughness.

The steel plates have a microstructure containing two phases, that is, quasi-polygonal ferrite and bainite, and MA produced therein; MA has a area fraction of 3% to 20% and an equivalent circle diameter of 3.0 I'm or less; and bainite has a area fraction of 5% to 70%. The area fraction of MA was determined from the microstructure observed with a scanning electron microscope (SEM) by image processing.

On the other hand, the compositions of Nos. 8 to 13, which are examples of the present invention, are within the scope of preferred embodiments of the present invention and manufacturing methods thereof are outside the scope of preferred embodiments of the present invention. Therefore, the microstructures thereof are outside the scope of preferred embodiments of the present invention. The yield ratio or the uniform elongation is insufficient or sufficient strength or toughness is not achieved before or after strain ageing treatment at 250° C. for 30 minutes. The compositions of Nos. 14 to 16 are outside the scope of preferred embodiments of the present invention. Therefore, the yield ratio and uniform elongation of No. 14 and the tensile strength, uniform elongation, and yield ratio of No. 15 are outside the scope of preferred embodiments of the present invention.

The toughness of the welded heat affected zone (HAZ) of No. 16 is outside the scope of preferred embodiments of the present invention.

TABLE 1

| Steel | Chemical components (mass percent) | | | | | | | | | | | |
|---|---|---|---|---|---|---|---|---|---|---|---|---|
| type | C | Si | Mn | P | S | Al | Nb | Ti | Cu | Ni | Cr | Mo |
| A | 0.052 | 0.20 | 2.5 | 0.008 | 0.001 | 0.03 | 0.034 | 0.014 | — | — | — | — |
| B | 0.051 | 0.56 | 1.8 | 0.008 | 0.002 | 0.04 | 0.023 | 0.011 | 0.20 | 0.20 | — | — |
| C | 0.042 | 0.06 | 2.8 | 0.011 | 0.001 | 0.03 | 0.044 | 0.013 | — | — | — | — |

TABLE 1-continued

| | | | | | | | | | | | | |
|---|---|---|---|---|---|---|---|---|---|---|---|---|
| D | 0.054 | 0.53 | 1.7 | 0.008 | 0.001 | 0.03 | 0.012 | 0.009 | — | — | — | 0.10 |
| E | 0.054 | 0.15 | 2.2 | 0.008 | 0.001 | 0.04 | 0.025 | 0.008 | — | — | 0.10 | — |
| F | 0.052 | 0.16 | 2.3 | 0.009 | 0.001 | 0.03 | 0.009 | 0.016 | — | — | — | — |
| G | 0.053 | 0.13 | 1.9 | 0.008 | 0.001 | 0.03 | 0.014 | 0.013 | — | — | — | 0.20 |
| H | 0.023 | 0.38 | 2.4 | 0.008 | 0.002 | 0.03 | 0.032 | 0.010 | — | — | — | — |
| I | 0.052 | 0.65 | 1.1 | 0.009 | 0.001 | 0.03 | 0.024 | 0.011 | — | — | — | 0.10 |
| J | 0.071 | 0.34 | 2.2 | 0.008 | 0.001 | 0.03 | 0.035 | 0.014 | — | — | — | — |

| Steel | Chemical components (mass percent) | | | | | $Ar_3$ transformation temperature | | |
|---|---|---|---|---|---|---|---|---|
| type | V | Ca | B | N | O | (° C.) | Ti/N | Remarks |
| A | — | — | — | 0.004 | 0.002 | 694 | 3.5 | |
| B | — | — | — | 0.005 | 0.001 | 735 | 2.2 | Examples |
| C | — | — | — | 0.004 | 0.001 | 673 | 3.3 | |
| D | — | 0.0018 | — | 0.005 | 0.002 | 749 | 1.8 | |
| E | — | — | — | 0.005 | 0.002 | 716 | 1.6 | |
| F | 0.030 | — | — | 0.006 | 0.002 | 710 | 2.7 | |
| G | — | — | 0.0010 | 0.004 | 0.002 | 726 | 3.3 | |
| H | — | — | — | 0.005 | 0.001 | 711 | 2.0 | Comparative |
| I | — | — | 0.0008 | 0.004 | 0.002 | 798 | 2.8 | Examples |
| J | — | — | — | 0.004 | 0.002 | 712 | 3.5 | |

* Underlined values are outside the scope of the present invention.

* $Ar_3$ transformation temperature (° C.) = 910-310C—80Mn—20Cu—15Cr—55Ni—80Mo (the symbol of each element represents the content (mass percent) thereof.)

TABLE 2

| No. | Steel type | Plate thickness (mm) | Heating temperature (° C.) | Accumulative rolling reduction at 900° C. or lower (%) | Finish rolling temperature (° C.) | Initial cooling temperature (° C.) | Cooling rate (° C./s) | Final cooling temperature (° C.) | Reheating unit | Reheating rate (° C./s) | Reheating temperature (° C.) | Remarks |
|---|---|---|---|---|---|---|---|---|---|---|---|---|
| 1 | A | 20 | 1130 | 65 | 860 | 780 | 30 | 590 | Induction heating furnace | 2 | 650 | Examples |
| 2 | B | 20 | 1120 | 60 | 840 | 800 | 35 | 630 | Induction heating furnace | 3 | 650 | |
| 3 | C | 33 | 1080 | 70 | 850 | 810 | 20 | 610 | Induction heating furnace | 3 | 680 | |
| 4 | D | 20 | 1180 | 70 | 850 | 800 | 40 | 620 | Induction heating furnace | 5 | 650 | |
| 5 | E | 20 | 1050 | 60 | 840 | 790 | 35 | 540 | Gas burner furnace | 2 | 680 | |
| 6 | F | 33 | 1150 | 55 | 820 | 810 | 30 | 600 | Induction heating furnace | 3 | 660 | |
| 7 | G | 20 | 1150 | 75 | 870 | 820 | 35 | 570 | Induction heating furnace | 5 | 650 | |
| 8 | E | 20 | 970 | 75 | 850 | 790 | 35 | 610 | Induction heating furnace | 7 | 680 | Comparative Examples |
| 9 | E | 20 | 1150 | 40 | 820 | 800 | 40 | 580 | Induction heating furnace | 5 | 650 | |
| 10 | E | 20 | 1180 | 75 | 860 | 780 | 3 | 600 | Induction heating furnace | 6 | 680 | |
| 11 | F | 20 | 1100 | 65 | 820 | 800 | 35 | 460 | Induction heating furnace | 5 | 650 | |
| 12 | F | 20 | 1200 | 60 | 890 | 790 | 35 | 610 | Induction heating furnace | 0.2 | 680 | |
| 13 | F | 20 | 1080 | 70 | 860 | 820 | 40 | 550 | Induction heating furnace | 7 | 530 | |
| 14 | H | 20 | 1150 | 75 | 860 | 800 | 40 | 620 | Induction heating furnace | 6 | 650 | |
| 15 | I | 20 | 1090 | 70 | 870 | 810 | 40 | 510 | Induction heating furnace | 7 | 680 | |
| 16 | J | 20 | 1180 | 75 | 820 | 790 | 35 | 580 | Induction heating furnace | 2 | 650 | |

* Underlined values are outside the scope of the present invention.

TABLE 3

| No. | Steel type | Plate thickness (mm) | Area fraction of MA in microstructure of steel plate (%) | Equivalent circle diameter of MA in steel plate (μm) | Area fraction of bainite in microstructure of steel plate (%) | Before ageing at 250° C. for 30 min. Tensile strength (MPa) | Yield ratio (%) | Uniform elongation (%) |
|---|---|---|---|---|---|---|---|---|
| 1 | A | 20 | 11 | 1.6 | 45 | 621 | 75 | 10 |
| 2 | B | 20 | 8 | 1.2 | 41 | 562 | 74 | 10 |
| 3 | C | 33 | 13 | 2.6 | 38 | 677 | 71 | 9.3 |
| 4 | D | 20 | 7 | 1.7 | 33 | 543 | 75 | 11 |
| 5 | E | 20 | 6 | 1.6 | 55 | 624 | 73 | 9.1 |
| 6 | F | 33 | 10 | 1.3 | 52 | 613 | 78 | 11 |
| 7 | G | 20 | 4 | 1.5 | 47 | 588 | 70 | 10 |
| 8 | E | 20 | 1 | 2.5 | 64 | 502 | 89 | 5.8 |
| 9 | E | 20 | 7 | 3.5 | 56 | 588 | 77 | 10 |
| 10 | E | 20 | 2 | 2.4 | 24 | 520 | 87 | 9.0 |
| 11 | F | 20 | 0 | 1.5 | 86 | 655 | 94 | 5.6 |
| 12 | F | 20 | 1 | 1.6 | 48 | 660 | 83 | 5.1 |
| 13 | F | 20 | 0 | 1.3 | 55 | 571 | 89 | 5.8 |
| 14 | H | 20 | 1 | 1.4 | 52 | 655 | 88 | 4.9 |
| 15 | I | 20 | 0 | 1.8 | 16 | 483 | 86 | 5.8 |
| 16 | J | 20 | 14 | 4.3 | 66 | 643 | 66 | 10 |

| No. | Before ageing at 250° C. for 30 min. Base material toughness vE-30° C. (J) | HAZ toughness vE-30° C. (J) | After ageing at 250° C. for 30 min. Tensile strength (MPa) | Yield ratio (%) | Uniform elongation (%) | Base material toughness vE-30° C. (J) | HAZ toughness vE-30° C. (J) | Remarks |
|---|---|---|---|---|---|---|---|---|
| 1 | 307 | 141 | 612 | 76 | 11 | 321 | 132 | |
| 2 | 312 | 124 | 555 | 75 | 10 | 304 | 133 | Examples |
| 3 | 294 | 118 | 664 | 74 | 9.0 | 288 | 122 | |
| 4 | 274 | 164 | 533 | 74 | 10 | 268 | 141 | |
| 5 | 318 | 155 | 611 | 73 | 9.0 | 307 | 146 | |
| 6 | 333 | 131 | 609 | 76 | 10 | 311 | 120 | |
| 7 | 361 | 182 | 571 | 72 | 10 | 341 | 152 | |
| 8 | 335 | 178 | 510 | 87 | 5.8 | 311 | 141 | Comparative |
| 9 | 129 | 124 | 577 | 78 | 9.0 | 134 | 102 | Examples |
| 10 | 273 | 138 | 526 | 86 | 8.0 | 266 | 108 | |
| 11 | 285 | 161 | 644 | 92 | 5.5 | 277 | 114 | |
| 12 | 288 | 144 | 657 | 84 | 5.5 | 269 | 138 | |
| 13 | 312 | 116 | 566 | 88 | 5.6 | 274 | 104 | |
| 14 | 293 | 122 | 615 | 86 | 5.3 | 288 | 133 | |
| 15 | 281 | 133 | 491 | 86 | 5.7 | 278 | 103 | |
| 16 | 302 | 28 | 623 | 69 | 9.0 | 245 | 19 | |

* Underlined values are outside the scope of the present invention.

The invention claimed is:

1. A steel plate having a composition containing 0.03% to 0.06% C, 0.01% to 1.0% Si, 1.2% to 3.0% Mn, 0.015% or less P, 0.005% or less S, 0.08% or less Al, 0.005% to 0.07% Nb, 0.005% to 0.025% Ti, 0.010% or less N, and 0.005% or less O on a mass basis, the remainder being Fe and unavoidable impurities; the steel plate having a metallographic microstructure that is a three-phase microstructure consisting of bainite, M-A constituent, and quasi-polygonal ferrite, the area fraction of the bainite being 5% to 70%, the area fraction of the M-A constituent being 3% to 20%, the remainder being the quasi-polygonal ferrite, the equivalent circle diameter of the M-A constituent being 3.0 μm or less; the steel plate having a yield ratio of 85% or less and a Charpy impact test absorbed energy of 200 J or more at −30° C. before or after being subjected to strain ageing treatment at a temperature of 250° C. or lower for 30 minutes or less.

2. The steel plate according to claim 1, further containing one or more selected from the group consisting of 0.5% or less Cu, 1% or less Ni, 0.5% or less Cr, 0.5% or less Mo, 0.1% or less V, 0.0005% to 0.003% Ca, and 0.005% or less B on a mass basis.

3. The steel plate according to claim 1, further having a uniform elongation of 6% or more and also having a uniform elongation of 6% or more after being subjected to strain ageing treatment at a temperature of 250° C. or lower for 30 minutes or less.

4. A method for manufacturing a steel plate, comprising heating steel having the composition specified in claim 1 to a temperature of 1000° C. to 1300° C., hot-rolling the steel at a finishing rolling temperature not lower than the $Ar_3$ transformation temperature such that the accumulative rolling reduction at 900° C. or lower is 50% or more, performing accelerated cooling to a temperature of 500° C. to 680° C. at a cooling rate of 5° C./s or more, and immediately performing reheating to a temperature of 550° C. to 750° C. at a heating rate of 2.0° C./s or more.

* * * * *